US006634121B2

(12) United States Patent
Sordi

(10) Patent No.: US 6,634,121 B2
(45) Date of Patent: Oct. 21, 2003

(54) SHOE WITH A SOLE COMPRISING A FOREFOOT PART DIVIDED INTO AT LEAST TWO ELEMENTS

(75) Inventor: Luca Sordi, Chiavari (IT)

(73) Assignee: Freddy S.p.A., Chiavara (IT)

( * ) Notice: Subject to any disclaimer, the term of this patent is extended or adjusted under 35 U.S.C. 154(b) by 0 days.

(21) Appl. No.: 09/750,962

(22) Filed: Dec. 28, 2000

(65) Prior Publication Data

US 2001/0005947 A1 Jul. 5, 2001

(30) Foreign Application Priority Data

Dec. 30, 1999 (IT) ..... MI99A2748

(51) Int. Cl.[7] ..... A43B 1/10; A43B 13/00

(52) U.S. Cl. ..... 36/102; 36/8.3; 36/31; 36/103

(58) Field of Search ..... 36/102, 31, 88, 36/103, 3 R, 3 B, 25 R, 30 R, 30 A, 35 R, 37, 8.3

(56) References Cited

U.S. PATENT DOCUMENTS 1,974,456 A * 9/1934 Goldzweig ..... 36/3 B
2,884,716 A * 5/1959 Shelare et al. ..... 36/3 R
4,309,832 A * 1/1982 Hunt ..... 36/31
4,507,880 A * 4/1985 Ohashi ..... 36/3 B
4,541,186 A * 9/1985 Mulvihill ..... 36/114
4,542,598 A * 9/1985 Misevich et al. ..... 36/114
4,554,749 A * 11/1985 Ostrander ..... 36/102
4,680,875 A * 7/1987 Danieli ..... 36/31
5,325,611 A * 7/1994 Dyer et al. ..... 36/30 R
5,367,791 A * 11/1994 Gross et al. ..... 36/31
5,384,973 A * 1/1995 Lyden ..... 36/102
5,544,429 A * 8/1996 Ellis, III ..... 36/30 R
5,915,820 A * 6/1999 Kraeuter et al. ..... 36/102
5,926,974 A * 7/1999 Friton ..... 36/31
6,237,251 B1 * 5/2001 Litchfield ..... 36/31

* cited by examiner

*Primary Examiner*—M. D. Patterson
(74) *Attorney, Agent, or Firm*—Steinberg & Raskin, P.C.

(57) ABSTRACT

A shoe comprising a sole provided with at least one part (1; 5, 6) for supporting at least partially the forefoot, said part being divided into at least two elements (3,4; 3A, 3B, 4B; 15A, 16) distinct and separated with each other, so as to increase the flexibility of the sole in correspondence with said forefoot, said two distinct elements (3, 4; 3A, 3B, 4B; 15A, 16) being connected to an upper face (7) of the shoe.

16 Claims, 4 Drawing Sheets

SHOE WITH A SOLE COMPRISING A FOREFOOT PART DIVIDED INTO AT LEAST TWO ELEMENTS

FIELD OF THE INVENTION

The present invention concerns a shoe according to the precharacterising portion of the main claim.

BACKGROUND OF THE INVENTION

First of all it is to be pointed out that in the present context the term forefoot means the part of the foot which extends from the plantar arc of the foot to the foot fingers, the latter being comprised.

There are well known shoes provided with soles comprising only two parts, the first one being provided in correspondence with the heel and the second one, separated from the first one, being provided in correspondence with the forefoot, these two parts being rigidly connected to an upper face of the shoe. The above mentioned shoes have good flexibility features, however they are not completely suited for some specific uses, such as, for example, modern dance, which requires both a good flexibility of the fore foot and support and protection against the stresses this part of the foot undergoes.

OBJECTS AND SUMMARY OF THE INVENTION

It is an object of the present invention to overcome the disadvantages of the known shoes and in particular to provide a shoe having a high flexibility in correspondence of the forefoot.

A further object is to provide a shoe whose sole may hold very well the foot and absorb at least partially the pushes received by the foot.

These and further objects which will be apparent to an expert in the art are achieved by a shoe in accordance with the characterising portion of the main claim.

The present invention will be more apparent from the accompanying figures provided by way of non-limiting example, in which.

DETAILED DESCRIPTION OF THE PREFERRED EMBODIMENTS

Figure 1:
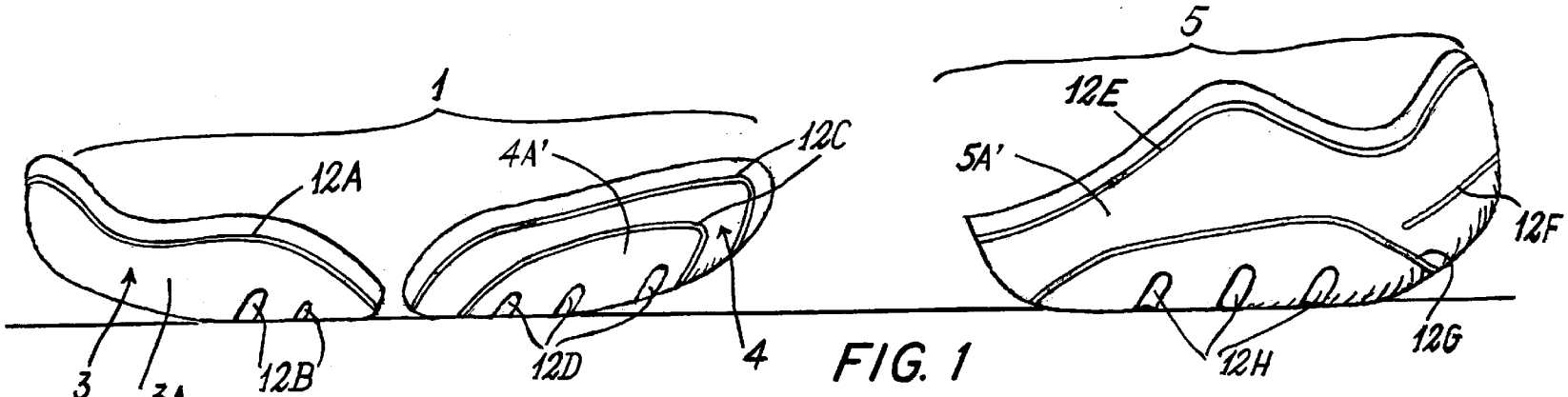
FIGS. 1 and 2 are, respectively, a side schematic view and a top plan view of a sole for a shoe according to the present invention.
Figure 2:
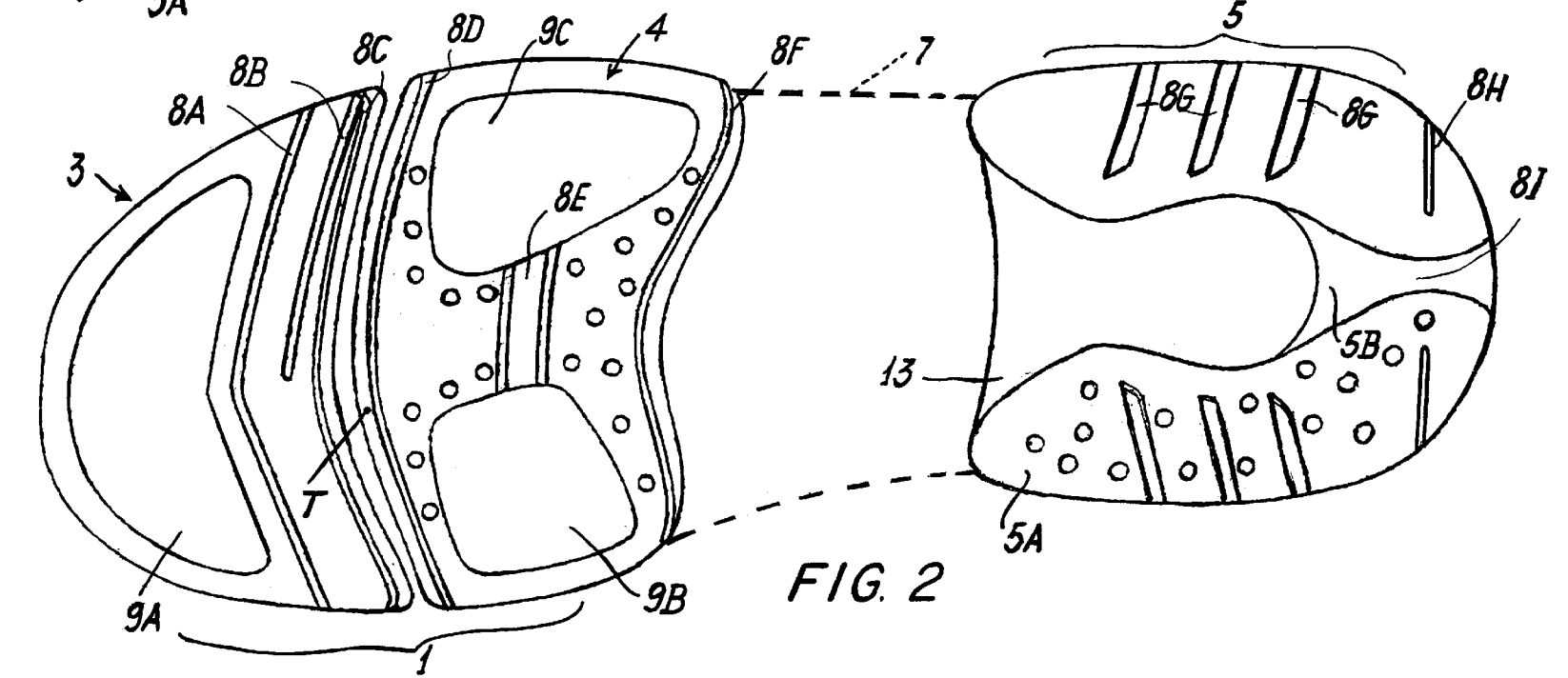
Figure 3:
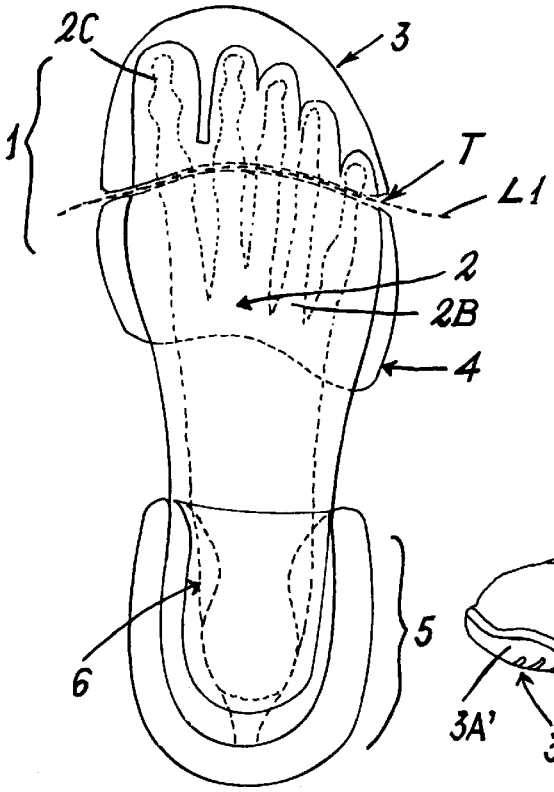
FIG. 3 is a schematic top plan view with a sketched representation of a foot.

Referring to FIGS. 1–4, these show a sole for a shoe according to the invention comprising: a first part 1, provided in correspondence with the forefoot 2 and fit for supporting it (FIG. 3), this first part being divided into two distinct and separated elements 3, 4, and a second part 5 provided in correspondence of the heel 6 and fit for supporting it. The two elements 3, 4 of part 1 of the forefoot and the heel part are distinct and separated from each other and rigidly connected, for example glued and/or sewed on a conventional end face 7 (FIG. 2) of the shoe. This end face could also be an intermediate wall provided between said end face of the shoe and the sole rigidly connected both to the sole and to the shoe end face, and extending along the whole of said end face or only a part of it.

Figure 4A:
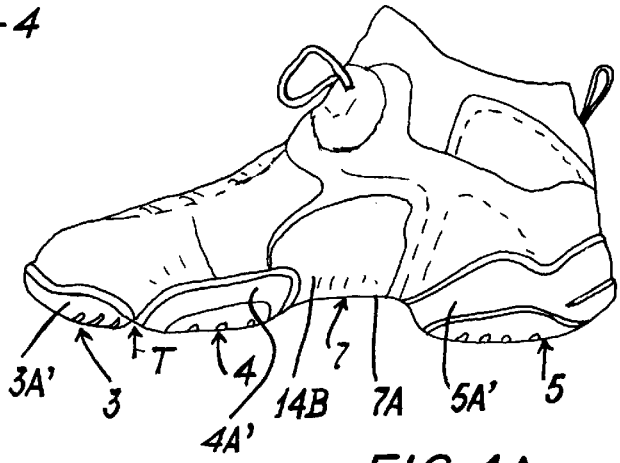
FIGS. 4A, 4B, 4C are schematic lateral views of a shoe according to the invention, comprising a sole as represented in the preceding figures used in three different ways.
Figure 4B:
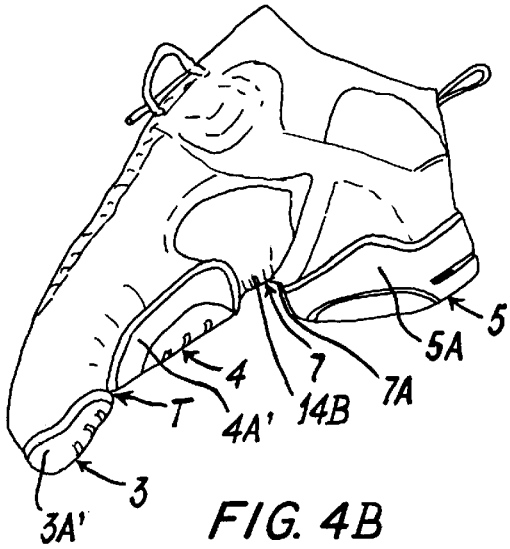
Figure 4C:
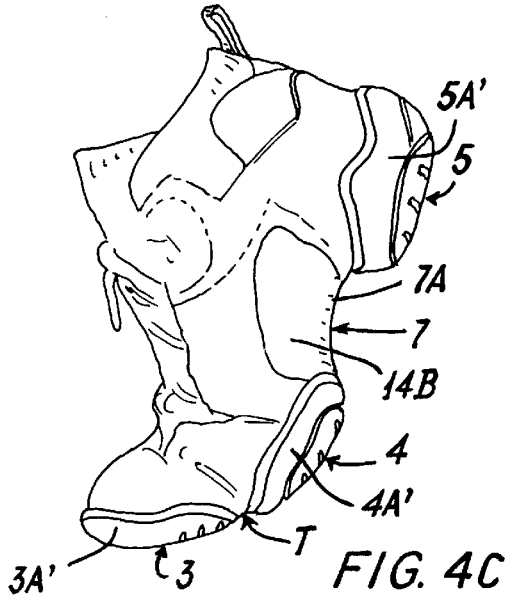

The two elements 3, 4 of part 1 of the forefoot of the shoe and also the heel part 5 have, in correspondence of their external surface, cavities 8A–I and a plurality of holes 10, for improving the flexibility of said two parts, this relates in particular to the cavities 8A–F, the gripping features of the sole, and, more generally, the exterior appearance of the sole. The two elements 3, 4 advantageously comprise also inserts 9A–C made of leather or in a plastic material presenting friction and rigidity features different from that of the plastic material the two elements 3, 4 are made with. The inserts 9A–C are rigidly connected to the two elements 3, 4 for example they are sewed. Advantageously in order to allow the inserts 9A–C and the visible surface of elements 3, 4 to form a common surface these elements are provided with hollow seats for said inserts. Said inserts 9A–C may, in particular, increase the behaviour of the sole with respect to its gripping features. Preferably, the two elements 3, 4 of the forefoot of part 1 of the shoe, and also the heel part 5 comprise side walls 3A', 4A', 5A' extending along the whole outer side of the sole, able to strengthen and increase the lateral holding of the shoe. Also these side walls 3A', 4A', 5A' comprises cavities 12A–H. The two forefoot elements 3, 4 of the sole are, preferably, shaped in such a way that the frontal element 3 supports a frontal part 2A of the forefoot, while the other element 4 supports a bottom part 2B of the forefoot, and a portion T (FIG. 2) separating the two elements 3 and 4 is located in correspondence with a line which goes through the joints of said two parts 2A 2B of the forefoot. These two parts 2A, 2B of the forefoot 2 are, advantageously the phalanxial and the metatarsal parts, in this way the two elements 3, 4 of the sole being separated by a line LI (FIG. 3) which goes through the metatarsal-phalanxial joints. FIGS. 4B and 4C show how a shoe according to the type described above greatly increase the possibility of movements of the forefoot. As a matter of fact, despite of the fact that in the known shoes, even if the metatarsal-phalanxial joints are greatly flexible, they are generally blocked and/or compressed, thanks to the shoe according to the invention the joints of the foot, and in particular the metatarsal-phalanxial one, have the possibility to move in a natural way, not being substantially blocked and/or compressed by the rigidity and/or partial elasticity of the sole.

Figure 5:
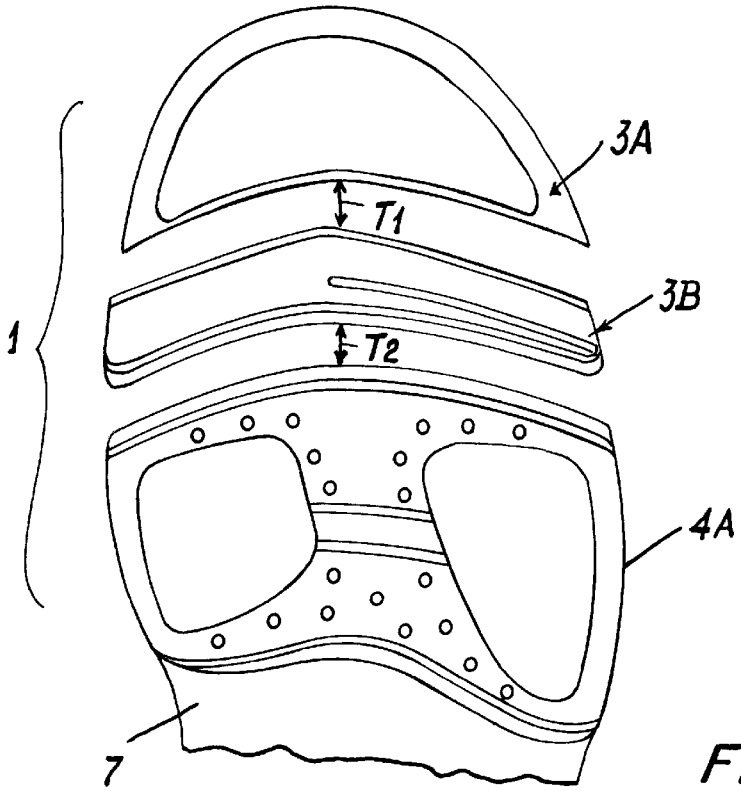
FIG. 5 is a schematic top plan view of the part which is able to support the forefoot according to a second embodiment of the shoe.
Figure 6A:
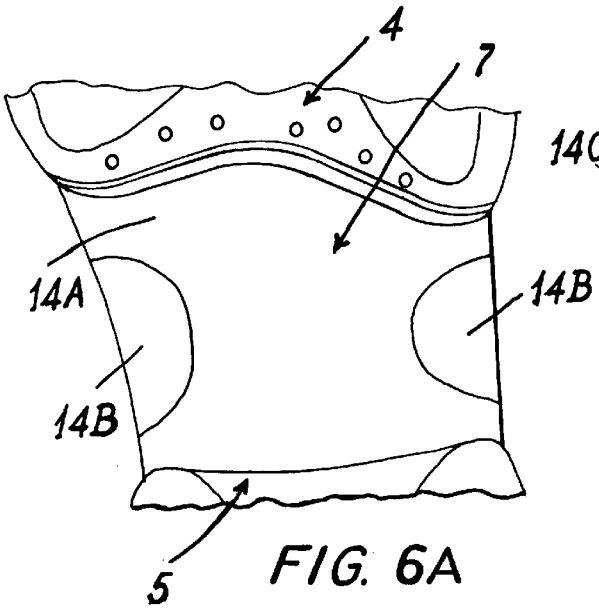
FIGS. 6A, 6B show partial schematic plan views of further embodiments of a shoe according to the present invention.
Figure 6B:
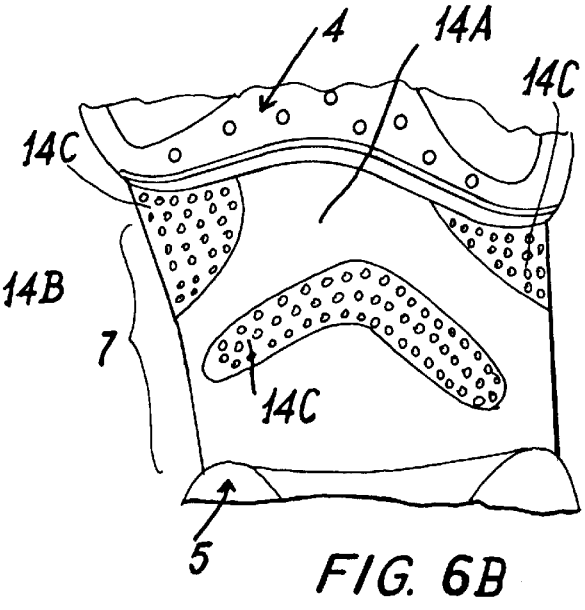

The portion T (FIG. 2) of the bottom face 7 of the shoe, which has no sole and separates the two elements 3 and 4 has a width comprised between 0.2 cm. and 2 cm, preferably about 0.5 cm. This portion T must be large enough for enabling at least a partial rotation of the two elements 3 and 4 one with respect to the other as shown in FIG. 4B, without an interference between the edges facing each of said elements. The larger portion T is the better it is the possibility of rotating one to the other of the two elements 3 and 4. Further, the width of portion T may vary depending on the shape and/or the use of the shoe. It is to point out that the two elements 3, 4 of the sole might also be separated along another joint line of the forefoot, for example along the line connecting the phalanxial joints, for example the proximal phalanxial joint with the distal ones. According to the invention, in order to further increase the flexibility of part 1 of the sole forefoot, and, therefore the performances of the shoe, this part could be divided into more than two elements, for example it might comprise three elements for supporting, respectively: the phalanxial distal part, the proximal one and the metatarsal part of the forefoot. In this embodiment, shown in FIG. 5, the three distinct elements 3A, 3B, 4A of part 1 of the forefoot of the sole are separated by portions T1, T2 which extend in correspondence with the lines which connect the phalanxial and metatarsal-phalanxial joints. The part 5 of the sole provided in correspondence with the heel is of a known type and, preferably, is of the U-shaped type for defining under the heel a cavity limited by the two U legs 5A and the base 5B of the U. This cavity is closed by a bridge element 13 made in a rigid material, the edges of this bridge elements resting on the edges of the part 5 of the sole limiting said cavity closer to the shoe. The bottom face 7 of the shoe to which there are connected the heel part 5 and the two elements 3, 4 of the fore foot part 1 of the sole is made in a flexible material such as, for example, leather and or textile. Advantageously, in order to further increase the flexibility of the shoe and its comfort, the part 7A of the face 7 without sole, provided in correspondence with the plantar arch of the foot, between the two parts 5 and 1 of the sole, is divided into subparts 14A, B, C made in material having different flexibility and transpirancy features. Advantageously, in a first embodiment (FIG. 6A) the parts 14B having more flexibility are the more external one and they extend also along the sides of the shoe (FIG. 4B, C). In an other embodiment (FIG. 6B) the more flexible parts 14C are made in a pierced material, such as a pierced textile, for improving also the transpirancy of the shoe (FIG. 6B). It is to be stressed that the embodiments relating to the shape of the part 7A of the face 7 of the shoe, provided in correspondence with the plantar arch of the foot, between the two parts 5 and 1 may also be used in the usual shoes comprising a sole divided into two parts: one in correspondence with the heel and the other in correspondence with the forefoot, the latter not being divided into two or more distinct elements.

Figure 7:
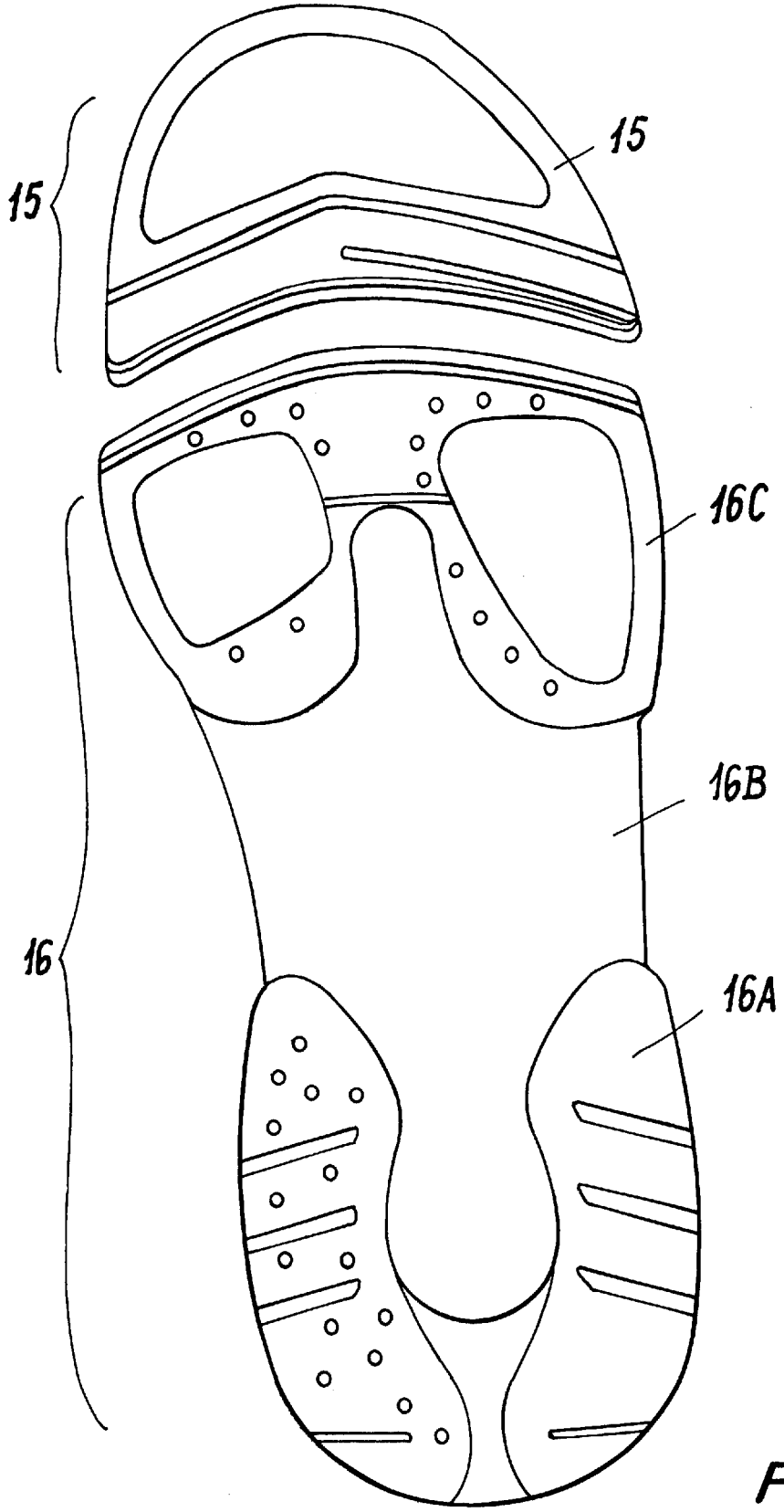
FIG. 7 is a schematic view from above of a further embodiment of a shoe according to the invention.

In a further embodiment, shown in FIG. 7, the sole is divided into only two parts 15, 16 extending, respectively: in correspondence of a frontal part of the forefoot and in correspondence: of the remaining part of the forefoot, of the plantar arch of the foot and the heel. According to this embodiment the sole is divided, for example, into a first element comprising a part 16A for supporting the heel, and a part 16B for the plantar arch of the foot and a part 16C for the forefoot, these being realised in one single piece, and a second element 15A for supporting a front part of the forefoot, the two elements 15A, 16C of the sole being separated and distinct from each other and connected to a lower wall of the shoe. In a variant according to this embodiment, the parts 15A, 16C and 16A of the sole could be substantially the same or similar to those described above, while the part 16B could be of the type usually used for supporting the plantar arch of the foot. The part 16B could also be an extension of the bridge element 13 described above. As represented in FIG. 5, the sole according to the variant represented in FIG. 7 could comprise in its forefoot part also three distinct parts; in this case the bottom part 4A would be made in a single piece with plantar and heel parts.

The parts 1, 5, 16A, 16C of the sole in correspondence with the heel and the forefoot are made in any known plastic material used in the shoe making field and presenting at least a partial elasticity, for at least partially supporting the stresses of the sole. For example, the above mentioned parts 1, 5, 16A, 16B of the sole could be made by thermoforming in a high density polyurethane or by moulding in ethyl-vinil acetate (E.V.A.) preferably a high density one. The soles described above are particularly fitted for being used in sports shoes, in particularly for dance, aerobic, and gym shoes.

It is finally to be stressed that the embodiments described above are described by way of a non limiting example and that are possible many variants all falling within the same scope of protection.

What is claimed is:

1. A shoe comprising:

a shoe upper;

a sole comprising:

a first part for supporting the forefoot secured to said shoe upper, a second part for supporting the heel secured to said shoe upper, wherein said first part for supporting the forefoot is divided into at least first and second elements distinct and separate from each other, said first and second elements being structured and arranged so that a line that separates said first and second elements is aligned with a line defined by a joint of a forefoot of a user whereby the flexibility of the sole is increased in an area of said forefoot without any intervening rigid layer between the shoe upper and the separate sole elements and wherein the only rigid layer in the shoe is the separate sole elements, wherein said shoe upper has a first exposed area between said first and second part, said exposed area corresponding in location to the plantar arch of said user; and wherein said shoe upper has a second exposed area between said first and second elements of said first part, said second exposed area having a distance of between 0.2 and 2 cm.

2. The shoe according to claim 1, wherein said line defined by a joint of said forefoot is the metatarsalphalanxial line of the joint.

3. The shoe according to claim 2, wherein said line defined by a joint of said forefoot is the interphalanxial proximal-distal line.

4. The shoe according to claim 1, wherein said second part of said sole for supporting the heel comprises a first U shaped member having two extending arms and a bridge element made from a rigid material interconnecting said two arms.

5. The shoe according to claim 1, wherein said sole comprises a plurality of cavities.

6. The shoe according to claim 1, wherein said at least first and second elements are made from at least a first material and wherein said first and second elements comprise a plurality of inserts made from at least a second material, said second material having different flexibility and friction properties relative to said first material.

7. The shoe according to claim 6, wherein said at least first and second elements are provided with hollow seats for receiving said plurality of inserts so that said inserts and a surface of said first and second elements define a common surface.

8. The shoe according to claim 1, wherein said exposed area of said shoe upper corresponding in location to the plantar arch of said user is composed from a plurality of interconnect parts said parts being made from a material having different flexibility and transpirancy features with respect to one another, selected ones of said plurality of parts having a relative higher level of flexibility, and wherein said selected ones of said plurality of parts having a relative higher level of flexibility are arranged along an external edge of said shoe upper and along each lateral shoe wall.

9. The shoe according to claim 8, wherein said parts being made from a material having different flexibility and transpirancy features are made from a pierced material.

10. The shoe according to claim 1, wherein said first part for supporting the forefoot comprises a third distinct element, and wherein said first, second and third elements are structured and arranged for respectively supporting the distal part of the phalanxials, the proximal one, and the metatarsal one, and that said three elements are separated from one another in correspondence with the phalanxials and metatarsal-phalanxial joint lines.

11. The shoe according to claim 1, wherein said shoe further comprises side portions for strengthening the lateral control of the shoe.

12. The shoe according to claim 10, wherein said third element is separated from said second element so said shoe upper has a third exposed area between said second and third elements of said first part, said third exposed area having a distance of between 0.2 and 2 cm.

13. The shoe according to claim 1, wherein said sole is made at least in part from an elastic material.

14. The shoe according to claim 13, wherein said sole is made from one of a high density polyurethane and entyl vinal acetate (E.V.A.).

15. The shoe according to claim 1, further comprising an intermediate wall arranged between said shoe upper and said sole, said intermediate wall being rigidly secured to said shoe upper and said sole.

16. A shoe comprising:

a shoe upper;

a sole comprising:

a first part for supporting the forefoot directly secured to said shoe upper, a second part for supporting the heel directly secured to said shoe upper, wherein said first part for supporting the forefoot is divided into at least first and second elements distinct and separate from each other, said first and second elements being structured and arranged so that a line that separates said first and second elements is aligned with a line defined by a joint of a forefoot of a user whereby the independent movement of the forefoot is permitted without any intervening rigid layer between the shoe upper and the separate sole elements and wherein the only rigid layer in the shoe is the separate sole elements, wherein said shoe upper material is exposed between said first and second part said exposed area corresponding in location to the plantar arch of said user; and wherein said shoe upper is exposed between said first and second elements of said first part, said exposed area between said first and second elements of said first part having a distance of between 0.2 and 2 cm.

* * * * *

UNITED STATES PATENT AND TRADEMARK OFFICE

CERTIFICATE OF CORRECTION

PATENT NO. : 6,634,121 B2
DATED : October 21, 2003
INVENTOR(S) : Luca Sordi

It is certified that error appears in the above-identified patent and that said Letters Patent is hereby corrected as shown below:

Title page,
Item [73], the residence of the Assignee, should read -- Chiavari (IT) --

Signed and Sealed this

Sixteenth Day of March, 2004

JON W. DUDAS
*Acting Director of the United States Patent and Trademark Office*